US007641312B2

(12) United States Patent
Takahashi

(10) Patent No.: US 7,641,312 B2
(45) Date of Patent: Jan. 5, 2010

(54) LIQUID EJECTING HEAD WITH NOZZLE OPENING AND LIQUID EJECTING APPARATUS INCLUDING SAME

(75) Inventor: Tomoaki Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 478 days.

(21) Appl. No.: 11/496,463

(22) Filed: Aug. 1, 2006

(65) Prior Publication Data

US 2007/0103511 A1 May 10, 2007

(30) Foreign Application Priority Data

Aug. 1, 2005 (JP) ..... 2005-223058
Jul. 25, 2006 (JP) ..... 2006-202176

(51) Int. Cl.
*B41J 2/135* (2006.01)
*B41J 2/15* (2006.01)

(52) U.S. Cl. ..... 347/45; 347/20

(58) Field of Classification Search ..... 347/47, 347/45, 20, 6, 65, 46, 36; 118/300; 246/446; 438/21

See application file for complete search history.

(56) References Cited

U.S. PATENT DOCUMENTS 4,183,030 A * 1/1980 Kaieda et al. ..... 347/6
6,019,457 A * 2/2000 Silverbrook ..... 347/65
6,074,040 A * 6/2000 Usui et al. ..... 347/45
6,432,348 B1 * 8/2002 Yamanaka ..... 264/446
6,450,615 B2 * 9/2002 Kojima et al. ..... 347/46
7,582,495 B2 * 9/2009 Suzuki et al. ..... 438/21
2003/0151639 A1 * 8/2003 Takahashi ..... 347/36
2005/0190231 A1 * 9/2005 Lim et al. ..... 347/45
2007/0247492 A1 * 10/2007 Mori ..... 347/45

FOREIGN PATENT DOCUMENTS

JP 2000-203033 A 7/2000
JP 2004-202867 A 7/2004
JP 2005-161679 A 6/2005

* cited by examiner

*Primary Examiner*—Stephen D Meier
*Assistant Examiner*—Carlos A Martinez, Jr.
(74) *Attorney, Agent, or Firm*—Sughrue Mion, PLLC

(57) ABSTRACT

A liquid ejecting head of the present invention has a nozzle plate including a nozzle substrate composed of a non-conductive material in which nozzle openings pass through the nozzle substrate and a conductive film formed to cover at least a part of the inner peripheral wall surface of the nozzle opening. The film forming area where the conductive film is formed includes the moving range of a meniscus moving on the inner peripheral wall surface of the nozzle opening in accordance with the ejection operation of liquid drops from the nozzle opening. According to the present invention, even if a non-conductive nozzle plate is used, a charge can be injected smoothly into liquid drops without causing problems of deterioration of the image quality due to electrophoresis and of defective ejection due to foreign substances and gas generated by electrolysis.

12 Claims, 7 Drawing Sheets

LIQUID EJECTING HEAD WITH NOZZLE OPENING AND LIQUID EJECTING APPARATUS INCLUDING SAME

CROSS REFERENCE TO RELATED APPLICATIONS

This application is based upon and claims the benefit of priority from the prior Japanese Patent Applications Nos. 2005-223058 and 2006-202176, the entire contents of which are incorporated herein by reference.

BACKGROUND OF THE INVENTION

1. Field of the Invention

The present invention relates to a liquid ejecting head for ejecting a liquid drop from a nozzle opening by changing a pressure of a liquid inside a pressure chamber interconnected to the nozzle opening, and a liquid ejecting apparatus having the liquid ejecting head.

2. Description of the Related Art

As a representative example of conventional liquid ejecting apparatuses, there is an ink jet recording apparatus having an ink jet recording head for image recording. As other liquid ejecting apparatuses, for example, an apparatus having a coloring material ejecting head used to manufacture a color filter for a liquid crystal display, an apparatus having an electrode material (conductive paste) ejecting head used to form an electrode for an organic EL display or a face emission display (FED), an apparatus having a biological organic substance ejecting head used to manufacture biological chips, and an apparatus having a sample ejecting head as a precise pipette may be cited.

The ink jet recording apparatus, which is a representative example of the liquid ejecting apparatus, has been used in various types of printing including color printing in recent years since noise during printing is comparatively low and moreover small dots can be formed at a high density.

Such an ink jet recording apparatus generally includes an ink jet recording head moving back and forth in the width direction (head scanning direction) of a recording medium (a processed article) such as a recording form loaded on a carriage and a paper feed mechanism for moving the recording medium in the direction (feeding direction) perpendicular to the head scanning direction and additionally includes a platen arranged opposite to the recording head for supporting the recording medium fed by the paper feed mechanism from the rear thereof and defining the position of the recording medium for the recording head.

In this ink jet recording apparatus, printing is executed by ejecting ink drops from the recording head to the recording medium in correspondence to print data. And, the recording head loaded on the carriage is designed so as to eject ink of various colors, for example, black, yellow, cyan, and magenta, thus not only text printing by black ink but also full-color printing by changing the ejection rate of each ink can be executed.

When printing the overall surface of a recording medium without leaving blanks on the edges thereof (so-called four-side edge-free printing) using this ink jet recording apparatus, in consideration of an allowance for shifting of the recording medium and carriage, an area slightly wider than the size of the recording medium is printed.

Namely, to print the recording medium without leaving blanks on the left and right edges (the edges extending in the feeding direction) thereof, the scanning range of the recording head during printing can be set to positions shifted outside from the edges of the recording medium.

Furthermore, when printing the recording medium without leaving blanks on the front and rear edges (the edges extending in the head scanning direction) thereof, at start time of printing of the recording medium, up to an area shifted forward from the front edge of the recording medium is designated as an area to be printed and at end time of printing of the recording medium, up to an area shifted backward from the rear edge of the recording medium is designated as an area to be printed.

And, ink drops ejected toward the areas other than the recording medium are absorbed by an absorption member (sponge, etc.) arranged on the rear side of the recording medium opposite to the recording head.

As mentioned above, when printing the recording medium without leaving blanks on the edges thereof, ink drops are ejected into the areas shifted from the edges thereof in the longitudinal direction or transverse direction. Therefore, a problem arises that an ink mist moved on the rear side of the recording medium is stuck to the edges of the rear thereof, thus the recording medium is soiled. Particularly, a case of executing double-side printing on a recording medium and a case of printing a recording medium using both sides like a postal card cause a problem. Further, problems also arise that misted ink soils the inside of the apparatus, and an operation defect is caused by adhesion of an ink mist to the electrical circuit and linear scale, and an ink mist is accumulated on the ink cartridge, thereby soils the user's hands.

Further, generally, the feed mechanism for feeding a recording medium in the feeding direction has rollers arranged opposite to each other so as to hold and feed it. One of the rollers arranged opposite to each other is a drive roller having a structure of baking aluminum on the surface of a metallic roller to improve the frictional force and the other roller is a follower roller made of plastics.

And, generally, the recording medium, at the point of time when it is fed into the print area, is electrically charged by contact or separation between the rollers and the recording medium, rubbing with the next recording medium when feeding the recording medium from the auto sheet feeder, or contact with the structural member on the feed route of the recording medium. And, when the recording medium is electrically charged like this, an ink mist is easily stuck to the rear of the recording medium.

To solve those problems, for example, a method for generating an electric field between a nozzle plate and an absorption member so as to move ink drops up to the absorption member by the Coulomb force, thereby preventing them from misting is proposed. This method is required to generate an electric field so as to inject an electrical charge into ink drops. Conventionally, the nozzle plate is formed by a metallic member (conductive member), so that an electrical charge can be injected into ink via the contact surface between the nozzle plate and the ink. In the metallic nozzle plate, the nozzle openings are formed by pressing.

As a document disclosing the related art, for example, JP-A No. 2004-202867 may be referred to.

However, in order to realize a higher image quality and a higher speed of the ink jet recording apparatus, it is necessary to increase the density of a plurality of nozzle openings (nozzle density) formed on the recording head, thus it is difficult to form nozzles by pressing of a metallic plate.

As a method for forming nozzle openings at a high density, laser processing for a resin plate using, for example, excimer laser, photolithography using photosensitive resin, and dry etching for an Si substrate are known.

However, nozzle plates manufactured by these methods are all formed by a non-conductive member, so that it is impossible to inject an electrical charge into ink drops via a nozzle plate.

When ink in the recording head is not electrically conducted to the ground (Gnd) (or to the power source), ink drops can be electrically charged initially by dielectric polarization. However, the ink in the recording head is gradually charged and becomes equal to the potential on the absorption member side, thus no potential difference is generated so that the effect cannot be continued.

Further, when the electrode for injecting an electrical charge into ink is installed in the ink flow path of the recording head, an electric field is generated in the ink in the recording head. Therefore, there are worries that electrophoresis occurs in the ink in the recording head, thus the image quality is deteriorated due to irregularities in the coloring material density in the recording head or electrolysis occurs in aqueous ink, and foreign substances and gas are generated, thus defective ejection is caused.

Further, there is a nozzle plate formed by electroforming using Ni, etc. A problem arises that electroforming is not productive and is expensive.

Further, conventionally, for the flow path substrate in which the pressure chambers interconnected to the nozzle openings and the flow path for feeding ink to the pressure chambers are formed, a Si single-crystal substrate is used in order to form a precise flow path at a high aspect ratio. When the recording head becomes longer in correspondence with an increase in the printing speed of the ink jet recording apparatus, if the flow path substrate and nozzle plate are formed by materials different in the coefficient of linear expansion, it is difficult to ensure the reliability of the head with respect to change in the temperature environment.

Also from this viewpoint, in place of the conventional metallic nozzle plate, it is preferable to use a nozzle plate of the same material as that of the flow path substrate. In this case, the nozzle plate is non-conductive so that the aforementioned problem arises with respect to the injection of an electrical charge into ink drops.

SUMMARY OF THE INVENTION

The present invention was developed, taking the foregoing circumstances into account, and is intended to provide a liquid ejecting head for smoothly injecting an electrical charge into liquid drops without causing problems of deterioration of the image quality due to electrophoresis and of defective ejection due to foreign substances and gas generated by electrolysis, even if a non-conductive nozzle plate is used, and a liquid ejecting apparatus using the liquid ejecting head.

In order to solve the aforementioned problems, the present invention is a liquid ejecting head for ejecting a liquid drop from a nozzle opening by changing a pressure of a liquid inside a pressure chamber interconnected to the nozzle opening, including: a nozzle plate including a nozzle substrate made of a non-conductive material, the nozzle opening being formed to pass through the nozzle substrate; and a conductive film formed so as to cover at least a part of an inner peripheral wall surface of the nozzle opening, a film forming area of the conductive film including a moving range of a meniscus which moves on the inner peripheral wall surface of the nozzle opening in accordance with an ejection operation of the liquid drop from the nozzle opening.

Preferably, the nozzle opening has a narrow part formed on an ejection surface side of the nozzle substrate and an enlarged part formed on an opposite ejection surface side with respect to the narrow part, the enlarged part having a sectional area larger than a sectional area of the narrow part with respect to a section perpendicular to an ejection direction of the liquid drop, an inner peripheral wall surface of the narrow part including the moving range of the meniscus.

Preferably, an overall surface of the nozzle substrate on the ejection surface side is covered with a water repellent film made of a water repellent material, the conductive film being formed not only on the part of the inner peripheral wall surface of the nozzle opening but also overall between the nozzle substrate and the water repellent film.

Preferably, the water repellent film is not formed on a part of the surface of the nozzle substrate on the ejection surface side so that a part of the conductive film is exposed on the part where the water repellent film is not formed.

Preferably, the conductive film is formed not only on the part of the inner peripheral wall surface of the nozzle opening but also overall a surface of the nozzle substrate on an opposite ejection surface side.

Preferably, a part of the conductive film is extended up to an end surface of the nozzle substrate so as to be exposed on the end surface.

Preferably, the liquid ejecting head further includes a head cover made of a conductive material, the head cover being mounted on the ejection surface side of the liquid ejecting head, the part, which is exposed, of the conductive film is electrically conducted to the head cover.

Preferably, at least a part of the conductive film corresponding to the moving range of the meniscus is hydrophilic.

Preferably, the conductive film is electrically conducted to an external circuit.

In order to solve the aforementioned problems, the liquid ejecting apparatus of the present invention includes any of the liquid ejecting heads aforementioned and an opposite electrode arranged on a rear side of an article to be processed so as to be opposite to the liquid ejecting head, the liquid ejecting apparatus being structured so as to generate a potential difference between the conductive film and the opposite electrode.

Preferably, the opposite electrode is made of an absorption member for receiving and absorbing the liquid drop ejected from the nozzle opening toward an area other than the processed article.

According to the present invention, even if a nozzle plate formed by a nozzle substrate made of a non-conductive material is used, an electrical charge can be injected smoothly into liquid drops without causing problems of deterioration of the image quality due to electrophoresis and of defective ejection due to foreign substances and gas generated by electrolysis.

BRIEF DESCRIPTION OF THE DRAWINGS

The foregoing and other objects, features, and advantages of the present invention will be understood from the following detailed description in connection with the accompanying drawings.

DESCRIPTION OF THE PREFERRED EMBODIMENTS

Hereinafter, the ink jet recording apparatus as an embodiment of the liquid ejecting apparatus having the liquid ejecting head of the present invention will be explained with reference to the accompanying drawings.

Figure 1:
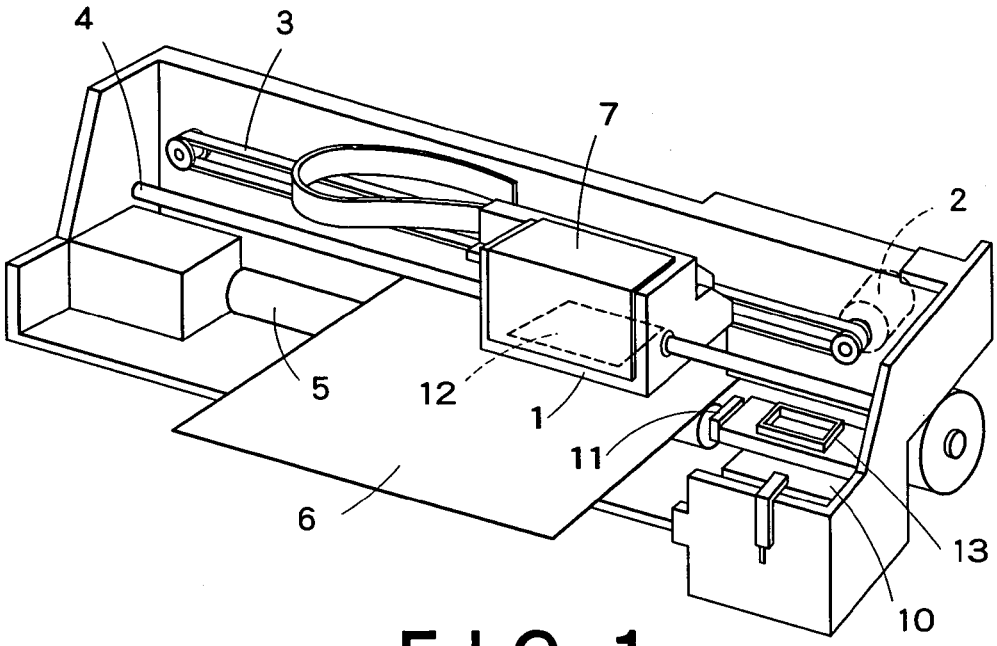
FIG. 1 is a perspective view showing the schematic constitution of the internal structure of the ink jet recording apparatus as an embodiment of the liquid ejecting apparatus according to the present invention.
Figure 2:
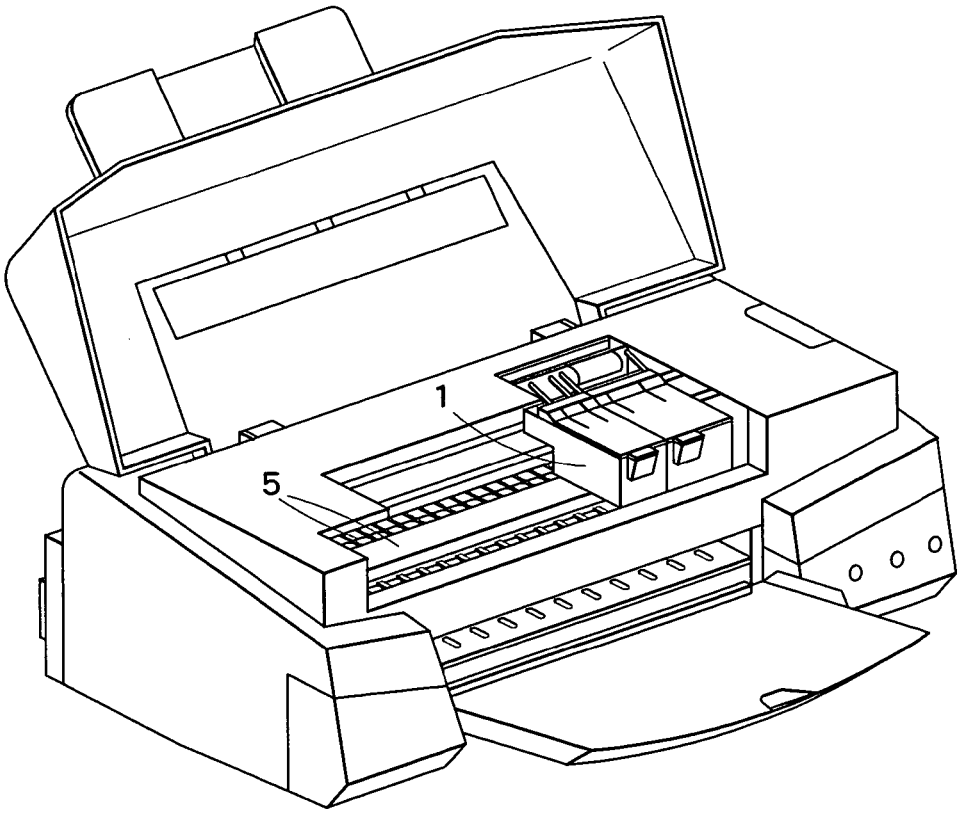
FIG. 2 is a perspective view showing the schematic constitution of the ink jet recording apparatus as an embodiment of the liquid ejecting apparatus according to the present invention.
Figure 3:
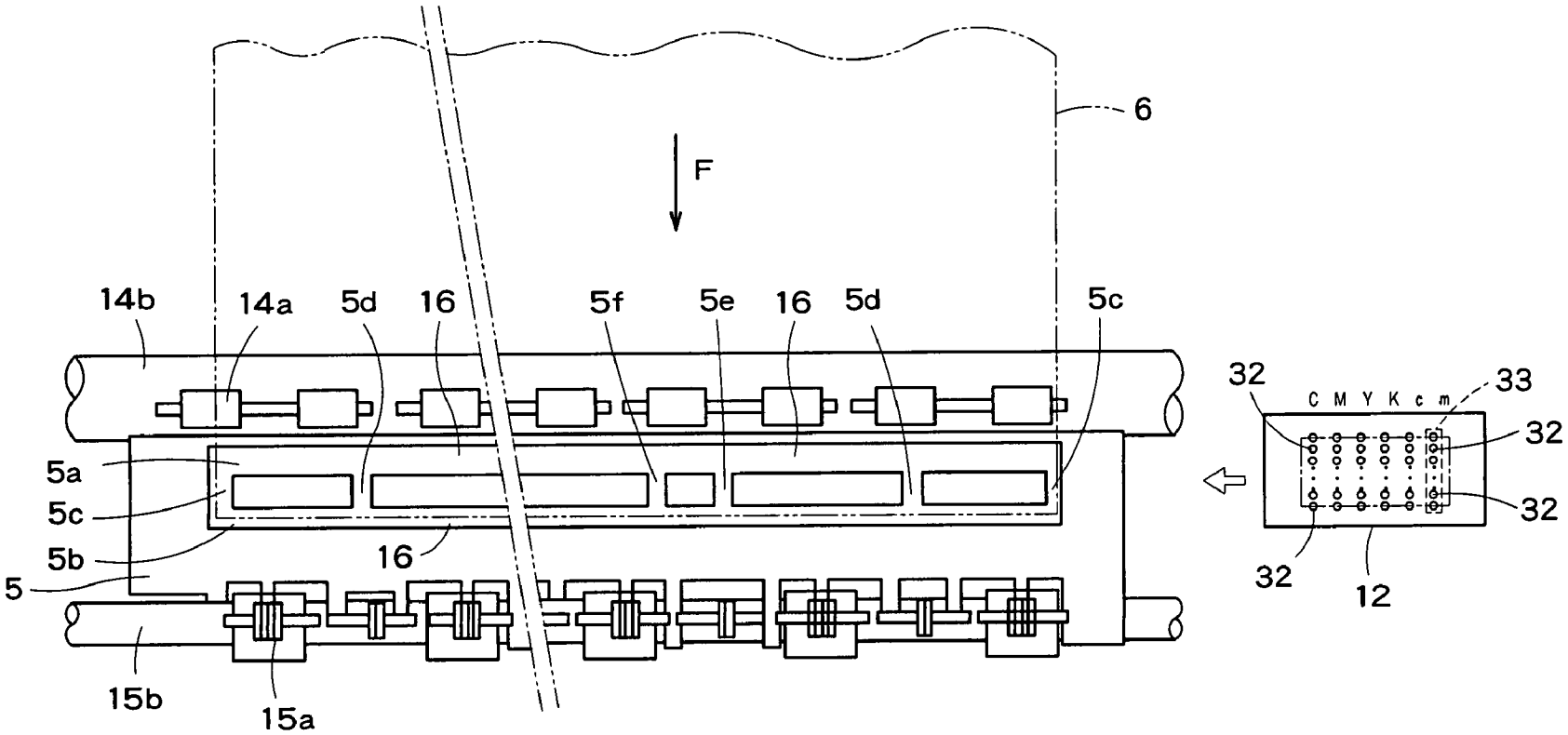
FIG. 3 is an enlarged partial plan view showing the platen and its circumference of the ink jet recording apparatus as an embodiment of the liquid ejecting apparatus according to the present invention.

FIGS. 1 and 2 are perspective views showing the schematic constitution of the ink jet recording apparatus of this embodiment and FIG. 3 is an enlarged drawing showing the platen and its circumference of the ink jet recording apparatus. In FIG. 1, numeral 1 indicates a carriage and the carriage 1 is structured so as to be guided by a guide member 4 via a timing belt 3 driven by a carriage motor 2 so as to move back and forth in the axial direction of a platen 5. The platen 5 supports recording paper (an article to be processed) 6 from the rear thereof so as to define the position of the recording paper 6 with respect to a recording head 12.

The recording head 12 is structured with pressure generation elements installed in correspondence with pressure chambers which are interconnected to nozzle openings, respectively, so as to change the pressure of ink inside the pressure chambers and eject ink drops from the nozzle openings. As pressure generation elements, for example, piezoelectric vibrators can be used.

The carriage 1, carriage motor 2, timing belt 3, and guide member 4 compose a scanning mechanism for scanning the ink jet recording head 12 in the head scanning directions together with the carriage 1.

The ink jet recording head 12 is loaded on the carriage 1 so as to be opposite to the recording paper 6. Further, on the carriage 1, an ink cartridge 7 for supplying ink to the recording head 12 is mounted removably.

In the home position (on the right side of FIG. 1) which is a non-printing area of the ink jet recording apparatus, a cap member 13 is arranged and the cap member 13 is structured so as to be pressed against the nozzle forming surface of the recording head 12 and form a closed space between the nozzle forming surface and itself, when the recording head 12 loaded on the carriage 1 moves to the home position. And, under the cap member 13, a pump unit for giving a negative pressure to the closed space formed by the cap member 13 is arranged.

In the neighborhood of the cap member 13 on the printing area side, a wiping means 11 having an elastic plate such as rubber is arranged, for example, so as to move back and forth in the horizontal direction with respect to the moving track of the recording head 12. When necessary, the carriage 1 moves back and forth on the side of the cap member 13 so that the wiping means 11 wipes the nozzle forming surface of the recording head 12.

The ink jet recording apparatus of this embodiment further includes a feed mechanism for intermittently feeding the recording paper 6 to be printed by the recording head 12 in the feeding direction perpendicular to the head scanning direction.

The feed mechanism, as shown in FIG. 3, includes paper feed rollers 14*a* and 14*b* arranged opposite to each other so as to hold and feed the recording paper 6 onto the platen 5, and paper ejection rollers 15*a* and 15*b* arranged opposite to each other so as to eject the printed recording paper 6. Further, the paper feed roller 14*a* and paper ejection roller 15*a* are driven rollers and the paper feed roller 14*b* and paper ejection roller 15*b* are drive rollers.

As shown in FIG. 3, a plurality of ink receiver openings 5*c*, 5*d*, 5*e*, and 5*f* extending in the parallel direction with the paper feeding direction F and a plurality of ink receiver openings 5*a* and 5*b* extending in the head scanning direction perpendicular to the paper feeding direction F are formed in the platen 5.

Among the plurality of ink receiver openings 5*c*, 5*d*, 5*e*, and 5*f*, a pair of ink receiver openings 5*c* are arranged so that the left and right edges of the recording paper 6 of size A3 respectively pass right above them, and a pair of ink receiver openings 5*d* are arranged so that the left and right edges of the recording paper 6 of size B4 respectively pass right above them, and a pair of ink receiver openings 5*e* are arranged so that the left and right edges of the recording paper 6 of size A4 respectively pass right above them, and a pair of ink receiver openings 5*f* are arranged so that the left and right edges of the recording paper 6 of size B5 respectively pass right above them.

Further, a plurality of ink receiver openings 5*a* and 5*b* are composed of a paper feed side ink receiver opening 5*a* arranged on the paper feed side and a paper ejection side ink receiver opening 5*b* arranged on the paper ejection side.

On each of the ink receiver openings 5*a*, 5*b*, 5*c*, 5*d*, 5*e*, and 5*f*, an absorption member 16 for absorbing ink ejected from the recording head 12 is arranged. The absorption member 16 is arranged so as to prevent it from making contact with the recording paper 6 on the rear side thereof.

In this embodiment, the absorption member 16 includes a conductive material and is formed, for example, by mixing polyethylene or polyurethane with a conductive material such as carbon and expanding them. Or, the absorption member 16 can be formed by giving a conductive material to an expanding agent of polyethylene or polyurethane by plating.

Further, by making the absorption member 16 soak an electrolytic water solution such as NaCl or KCl or water, conductivity can be given to it. Even when the absorption member 16 soaks only water, it takes in $CO_2$ in the atmosphere so as to become an electrolyte which is conductive.

As a simpler method, ink itself can be used as an electrolyte. In this case, before execution of the first no-edge printing, when the recording paper 6 is not fed, the carriage 1 is slowly scanned so as to prevent ink drops from misting, and ink drops are ejected from the recording head 12 to the absorption member 16. Thereby, the absorption member 16 soaks ink so that conductivity can be given to the absorption member 16.

Figure 4:
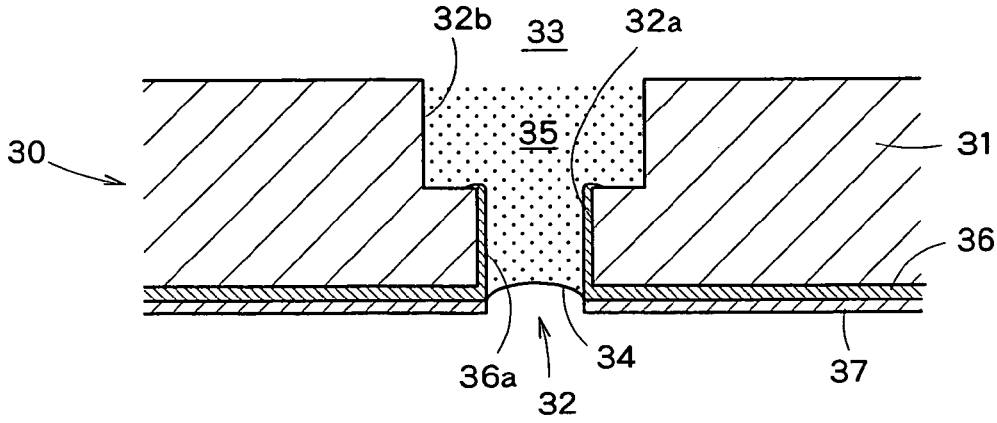
FIG. 4 is an enlarged partial vertical sectional view showing the essential section of the recording head as an embodiment of the liquid ejecting head according to the present invention.

FIG. 4 is a sectional view showing the enlarged essential section of the recording head 12 of this embodiment. The recording head 12 has a nozzle plate 30 on the side of the ejection surface (the surface opposite to the recording paper 6). The nozzle plate 30 includes a nozzle substrate 31 composed of a non-conductive material, preferably Si. The nozzle substrate 31 has a plurality of nozzle openings 32 formed by dry etching so as to pass through it.

Each of the nozzle openings 32 has a narrow part 32*a* formed on the nozzle substrate 31 on the ejection surface side and an enlarged part 32*b* formed on the opposite ejection surface side so as to be connected to the narrow part 32*a* at two steps. Regarding the section perpendicular to the ink drop ejection direction, the enlarged part 32*b* has a larger sectional area than that of the narrow part 32*a*.

The inner peripheral wall surface of the narrow part 32*a* includes the moving range of a meniscus 34 moving in correspondence with the ink drop ejection operation from the nozzle opening 32. Namely, when the pressure of ink 35 in a pressure chamber 33 is changed by a piezo-electric element in order to eject an ink drop from the nozzle opening, the meniscus 34 moves in correspondence with the pressure change, and furthermore, after ejection of ink drop from the nozzle opening 32, the meniscus 34 moves. Although the meniscus 34 moves in the ejection direction and opposite ejection direction in correspondence with the ink drop ejection operation like this, the moving range of the meniscus 34 at this time is controlled within the range where the narrow part 32*a* is formed.

In other words, an ink drop ejected from the nozzle opening 32 by one ejection is formed by the ink (or a part of it) filled in the narrow part 32*a*. The volume of the narrow part 32*a* is set at the volume or more of an ink drop for forming the largest dot.

And, in the recording head 12 of this embodiment, overall the inner peripheral wall surface of the narrow part 32*a* of the nozzle opening 32 and overall the surface of the nozzle substrate 31 on the ejection surface side, a conductive film 36 composed of a conductive material is formed. The conductive film 36 is preferably formed by Au, Cu, Ni, or NiCr, and the thickness thereof is preferably 0.1 to 5 μm.

Further, in the conductive film 31, at least the moving range of the meniscus 34 during the ink drop ejection operation is preferably hydrophilic. By doing this, the meniscus 34 is formed on a hydrophilic conductive film so that a charge can be surely ejected into ink in the neighborhood of the meniscus. Further, after ejection of ink drops, the meniscus can be reformed and refilled smoothly and quickly.

Further, a method for forming the hydrophilic conductive film 31 can be realized, for example, by use of a metal such as Au, Cu, Ni, or NiCr, the surface of which is modified by the plasma process or corona discharge process and is given a hydrophilic property or by use of a metallic oxide having conductivity such as titanium oxide or ITO.

On the surface of the conductive film 36 on the ejection surface of the nozzle substrate 31, a water repellent film 37 composed of a water repellent material is formed overall. The ejection surface side of the nozzle plate 30 is covered with the water repellent film 37 like this so that when the meniscus is expanded outside at time of ejection of an ink drop, ink is prevented from spreading to wet the outer periphery of the nozzle opening 32. Therefore, the ink drop ejection direction can be prevented from being deflected (wet deflection) by ink stuck to the outer periphery of the nozzle opening 32.

Figure 5:
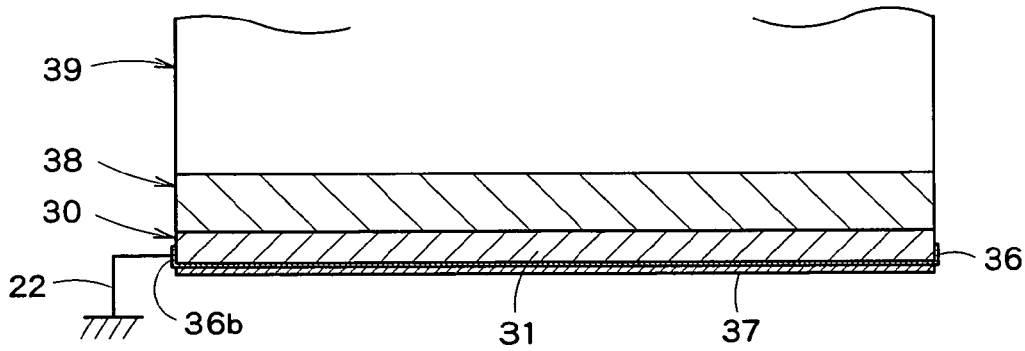
FIG. 5 is a partial vertical sectional view showing a part of the recording head as an embodiment of the liquid ejecting head according to the present invention.

As shown in FIG. 5, the nozzle plate 30 is joined to a flow path substrate 38. In the flow path substrate 38, the pressure chamber 33*s* interconnected to the nozzle openings 32 and the flow paths for feeding ink to the pressure chambers 33 are formed. The nozzle plate 30 is attached to a head case (head holder) 39 together with the flow path substrate 38.

Next, a method for forming the conductive film 36 and water repellent film 37 on the nozzle substrate 31 will be explained.

Firstly, by evaporation or sputtering from the side of the narrow part 32*a* of the nozzle opening 32, the conductive film 36 is formed on the surface of the nozzle substrate 31. At this time, particles move toward the inner peripheral wall surface of the narrow part 32*a*, thus a conductive film electrode 36*a* is formed. Further, as shown in FIG. 5, particles move toward the end face of the nozzle substrate 31, thus a conductive film end 36*b* is formed. Further, on the inner wall surface of the enlarged part 32*b* whose diameter is larger than that of the narrow part 32*a*, no conductive film is formed.

When the conductive film 36 is formed in this way, a masking member is pressed into the nozzle opening 32 from the side of the enlarged part 32*b* of the nozzle opening 32. Thus, the inner wall surface of the nozzle opening 32 is protected, and then the water repellent film 37 is formed.

Even after formation of the water repellent film 37, an end 36*b* of the conductive film 36 is exposed on the end face of the nozzle plate 30. A wire 22 is connected to the end 36*b* of the conductive film 36, and the conductive film 36 is grounded via the wire 22.

Figure 6:
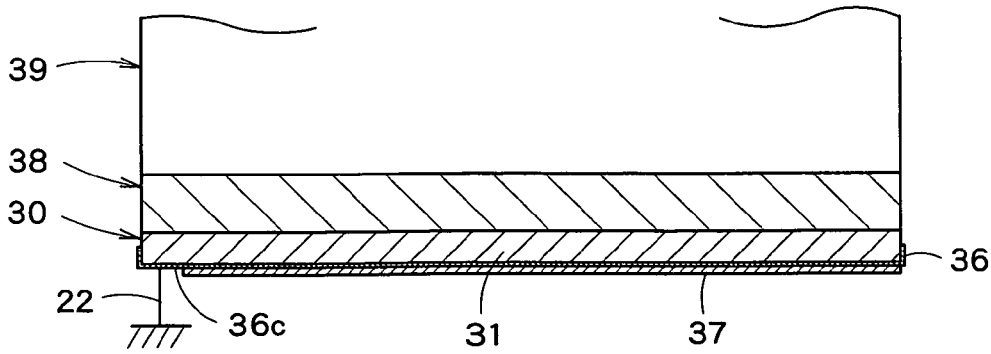
FIG. 6 is a partial vertical sectional view showing a modification of the recording head shown in FIG. 5.
Figure 7:
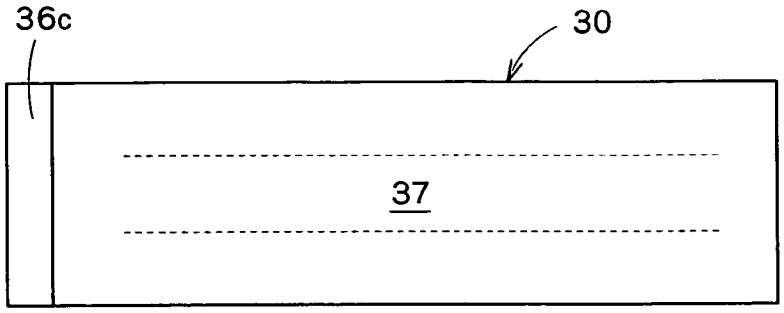
FIG. 7 is a schematic bottom view of the recording head shown in FIG. 6.

As a modification, as shown in FIGS. 6 and 7, it is possible to form a part where the water repellent film 37 is not formed by masking on the edge of the surface of the nozzle substrate 31 so as to form a conductive film exposure part 36*c* and connect the wire 22 to it.

Figure 8:
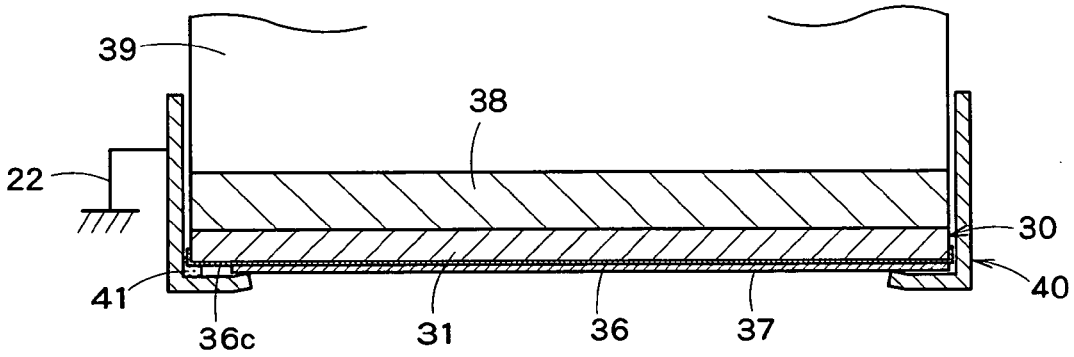
FIG. 8 is a partial vertical sectional view showing a modification of the recording head shown in FIG. 6.

As a more preferable aspect of the example shown in FIGS. 6 and 7, as shown in FIG. 8, it is possible to cover the conductive film exposure part 36*c* with a head cover 40 composed of a conductive material so as to prevent adhesion of ink and conduct the grounded head cover 40 and conductive film exposure part 36*c* with a conductive adhesive 41. Further, the head cover 40 functions to protect the head tip end.

Figure 9:
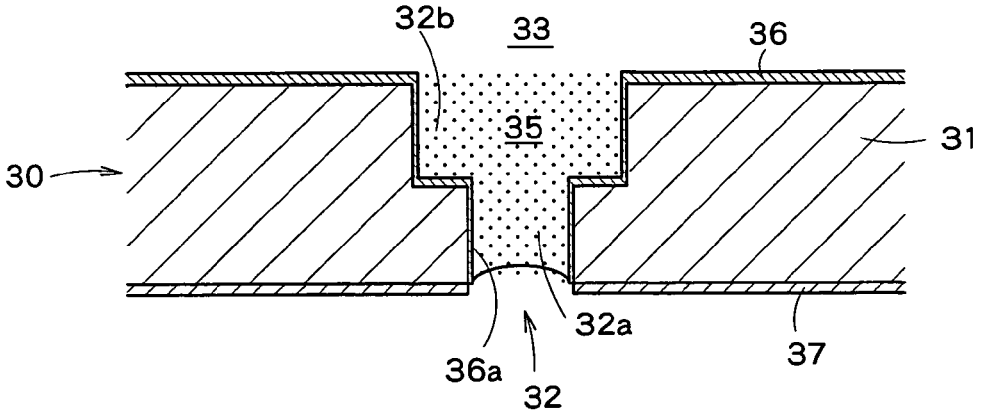
FIG. 9 is an enlarged partial vertical sectional view showing the essential section of a modification of the recording head shown in FIG. 4.
Figure 10:
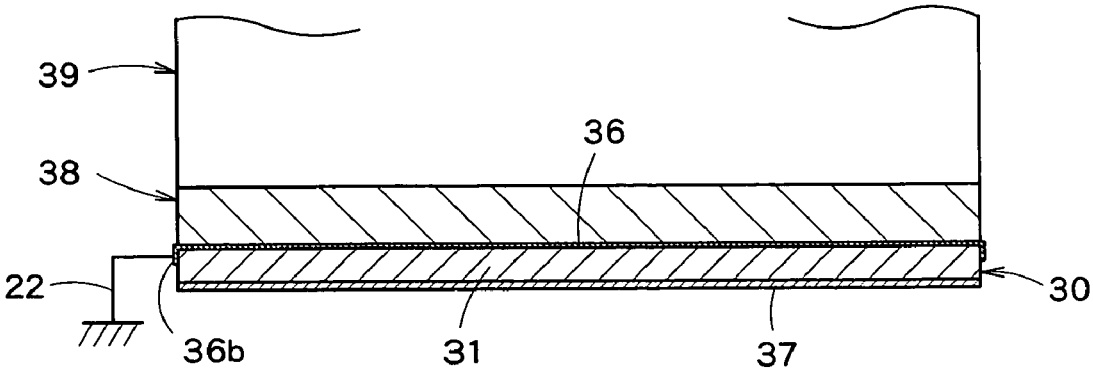
FIG. 10 is a partial vertical sectional view of the recording head shown in FIG. 9.

Furthermore, as another modification, as shown in FIGS. 9 and 10, it is possible to form only the water repellent film 37 on the ejection surface side of the nozzle substrate 31 and form the conductive film 36 overall the surface of the nozzle substrate 31 on the opposite ejection surface side (flow path side). In this example, the conductive film 36 is formed by evaporation or sputtering from the opposite ejection surface side of the nozzle substrate 31. Particles move toward the inner wall surfaces of the narrow part 32*a* and enlarged part 32*b* of the nozzle opening 32, thus the conductive film 36 is formed.

In this example, as shown in FIG. 10, the conductive film 36 is extended on the end face side of the nozzle substrate 31, thus the conductive film end 36*b* is formed. The conductive film end 36*b* is exposed on the end face of the nozzle substrate 31, and the wire 22 is connected to the exposed conductive film end 36*b* so that the conductive film 36 is grounded.

Further, also in the example shown in FIG. 10, similarly to the example shown in FIG. 8, the conductive film end 36*b* may be conducted to the head cover 40 via a conductive adhesive.

Figure 11:
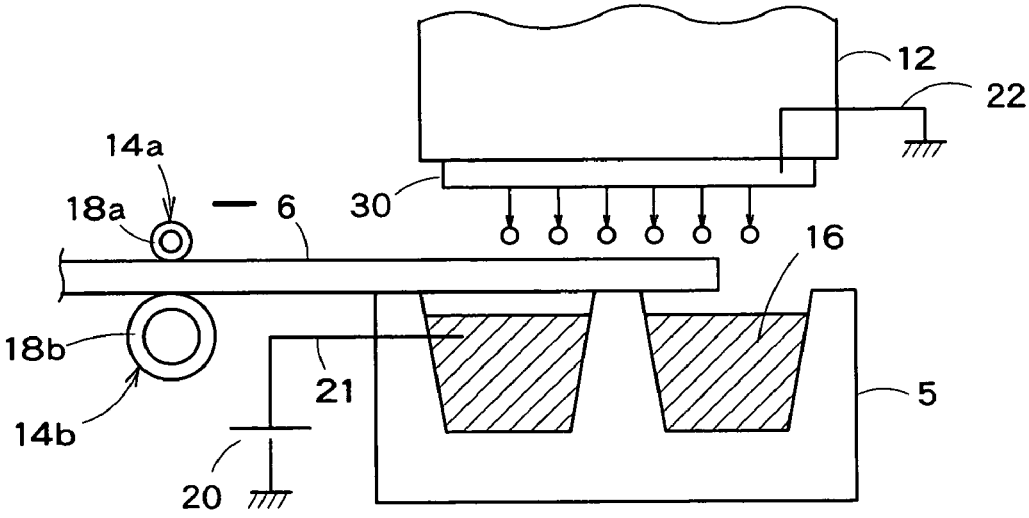
FIG. 11 is an enlarged vertical sectional view showing the essential section of the ink jet recording apparatus as an embodiment of the liquid ejecting apparatus according to the present invention.

Furthermore, the ink jet recording apparatus of this embodiment, as shown in FIG. 11, has a power source 20 and a wire 21 thereof for applying a positive voltage to the conductive absorption member 16. The power source 20 and wire 21, together with the wire 22 conducting to the conductive film 36, compose a potential difference generation means for generating a potential difference between the conductive film 36 of the nozzle plate 30 and the absorption member 16 arranged opposite to the nozzle plate 30 to function as an opposite electrode.

Figure 12:
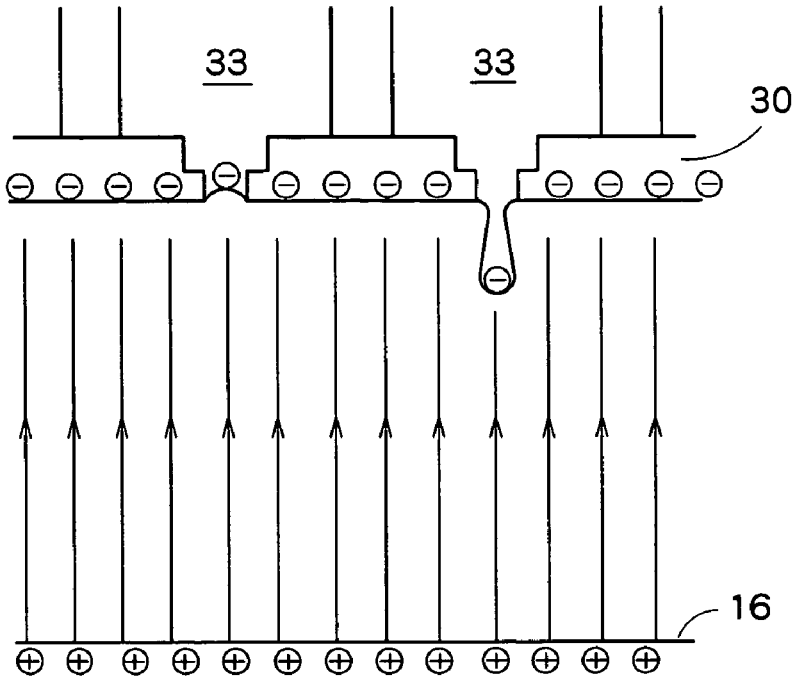
FIG. 12 is a drawing for explaining the operation of the ink jet recording apparatus as an embodiment of the liquid ejecting apparatus according to the present invention.

When a positive voltage is applied to the absorption member 16 by the potential difference generation means and the conductive film 36 of the nozzle plate 30 is grounded, as shown in FIG. 12, a positive charge is induced in the absorption member 16 and a negative charge is induced in the conductive film 36 of the nozzle plate 30. By doing this, as shown by the arrow in FIG. 12, parallel lines of electric force toward the nozzle plate 30 from the absorption member 16 are generated.

Further, when a negative charge is induced in the conductive film 36 of the nozzle plate 30, a negative charge is induced also in the meniscus in the nozzle opening 12*a*. The charge amount can be-calculated simply using the formula of a parallel-flat capacitor. An ink drop is ejected from the nozzle opening 12*a* with a negative charge corresponding to the area of the nozzle opening 12*a* and are applied with Coulomb force toward the absorption member 16 by an electric field generated between the conductive film 36 of the nozzle plate 30 and the absorption member 16.

As mentioned above, ink drops ejected from the nozzle opening 12*a* are applied with the Coulomb force toward the absorption member 16, so that even when an ink drop with a small size is ejected toward the area shifted outside from the edges of the recording paper 6, the ink drop can surely reach the absorption member 16. By doing this, ink drops ejected toward the area shifted outside the recording paper 6 can be prevented surely from misting. Therefore, even when printing the recording paper 6 without leaving blanks on the edges of the recording paper 6, adhesion of an ink mist to the edges of the rear of the recording paper 6 and staining of the inside of the apparatus due to an ink mist can be prevented.

Further, when the resistance of the recording paper 6 is lowered due to humidity and one end of the recording paper 6 having conductivity is grounded, an electric field is generated between the absorption member 16 with a voltage applied and the recording paper 6 so that no electric field is generated between the recording paper 6 and the nozzle plate 30. Therefore, a charge cannot be sufficiently injected into ink drops and the misting preventive effect by the potential difference generation means cannot be produced sufficiently.

Therefore, it is preferable to install holding means for holding the recording paper 6 under being processed in the electrically isolated state. In this embodiment, at least on the surfaces of the members such as the paper feed rollers 14*a* and 14*b* in contact with the recording paper 6 under being processed, insulating materials 18*a* and 18*b* are installed. As mentioned above, the recording paper 6 under being processed is held in the electrically isolated state by the holding means (the insulating materials 18*a* and 18*b*), thus the recording paper 6 acts just as a dielectric. Therefore, regardless of existence of the recording paper 6, a sufficient charge is induced in the conductive film 36 of the nozzle plate 30 so that a sufficient charge can be injected into ink drops.

Figure 13:
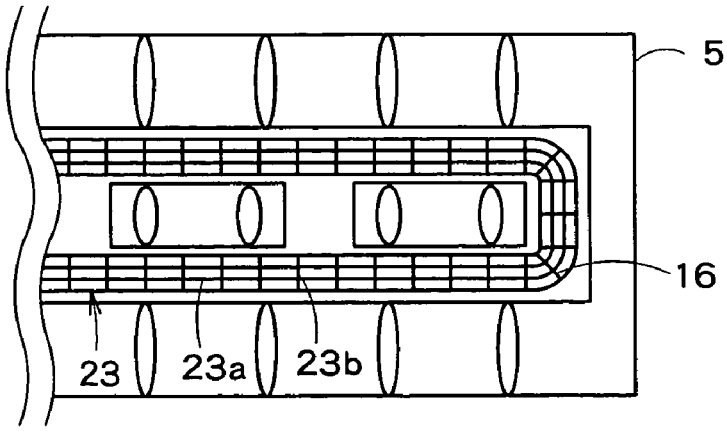
FIG. 13 is a partial plan view showing another modification of the liquid ejecting apparatus shown in FIG. 11.
Figure 14:
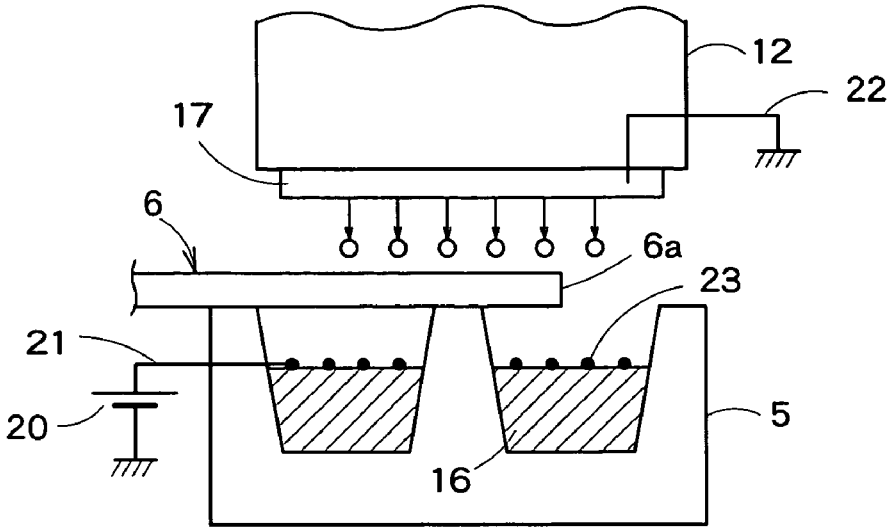
FIG. 14 is a partial vertical sectional view showing the modification shown in FIG. 13.

Further, as another modification of the embodiment aforementioned, as shown in FIGS. 13 and 14, a lattice-shaped member 23 composed of a conductive material is arranged on the top of the absorption member 16. A positive voltage can be applied from the power source 20 to the lattice-shaped member 23. The lattice-shaped member 23 includes a conductive part 23*a* extending in the head scanning direction and a conductive part 23*b* extending in the feeding direction.

In this modification, the absorption member 16 does not need to be made conductive, and for example, the absorption member 16 can be formed by sponge. Or, similarly to the embodiment shown in FIG. 11, it is possible to form the absorption member 16 by a conductive member and apply a voltage to both the lattice-shaped member 23 and the absorption member 16.

In this modification, ink drops attracted on the side of the lattice-shaped member 23 are ejected onto the surface of the lattice-shaped member 23 and then flow down onto the absorption member 16 or are directly ejected onto the absorption member 16.

Figure 15:
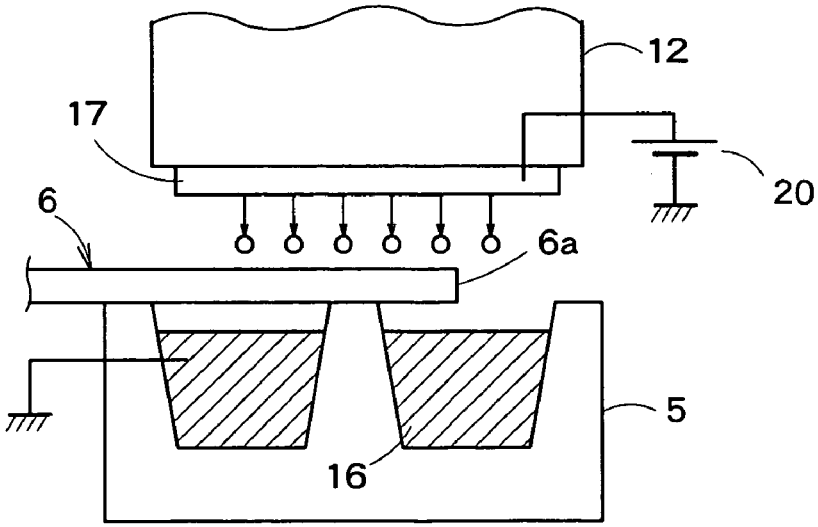
FIG. 15 is a partial vertical sectional view showing another modification of the liquid ejecting apparatus shown in FIG. 11.

Further, as still another modification of the embodiment aforementioned, the direction of the electric field generated by the potential difference generation means can be reversed. Namely, as shown in FIG. 15, it is possible to ground the absorption member 16 instead of the nozzle plate 30 and apply a positive voltage to the nozzle plate 30 by the power source 20. Furthermore, a constitution of properly switching the polarity of the voltage to be applied to the nozzle plate 30 may be used.

As mentioned above, according to the embodiments of the present invention and modifications thereof, the conductive film 36 is formed on the inner peripheral wall surface of the nozzle opening 32 and the conductive film 36 is grounded (or connected to the power source, i.e., connected to an external circuit), so that even if the nozzle substrate 31 is formed by a non-conductive material, a charge can be injected effectively and continuously into ink drops.

Further, the area where an electric field is generated in ink in the recording head 12 is only the inner wall of the narrow part 32*a* of the nozzle opening 32 and the surface of the meniscus. Therefore, a coloring material density difference due to electrophoresis is generated only in the narrow part 32*a* of the nozzle opening 32 and will not affect adversely the image quality. Namely, a meniscus is formed in the narrow part 32*a*, so that a charge is injected directly into the ink of the meniscus and no coloring material density difference due to electrophoresis is generated.

Further, even when electrolytic ink, which is easily electrolyzed, is used, even if electrolysis is generated, ink in the narrow part 32*a* is ejected together with products for each time, so that the products will not be accumulated and the reliability of the ejection operation will be not lost.

Further, the conductive film 36 is formed overall the surface of the nozzle substrate 31 so that the whole nozzle plate 30 becomes an electrode and can effectively act the Coulomb force on ink drops.

Further, as shown in FIG. 4, the conductive film 36 and water repellent film 37 are laminated on the surface of the nozzle substrate 31 on the ejection surface side, so that the nozzle plate 30 can be manufactured easily only by the one-side processing. Furthermore, the conductive film 36 is covered with the water repellent film 37 so that during the wiping operation for wiping out ink on the surface of the nozzle plate 30 or when paper jamming occurs, the conductive film 36 can be protected by the water repellent film 37.

Further, as shown in FIG. 9, when the conductive film 36 is formed on the surface of the nozzle substrate 31 on the opposite ejection surface side, the conductive film 36 is formed on a different surface from the water repellent film 37, so that when selecting the material of the water repellent film 37, there is no restriction imposed by the material of the conductive film 36 so that the adhesive strength of the water repellent film 37 can be ensured easily.

Further, as shown in FIG. 5, the end of the conductive film 36 is exposed on the end face of the nozzle substrate 31 and the conductive film electrode 36*a* is formed, thus the ground (or the power source) and the conductive film 36 can be easily conducted to each other.

Further, as shown in FIG. 6, the conductive film exposure part 36*c* is formed on the edges of the surface of the nozzle substrate 31 on the ejection surface side. Therefore, the ground (or the power source) and conductive film 36 can be easily conducted to each other. Furthermore, compared with a case that the ground and the end face of the nozzle substrate 31 are conducted to each other (FIG. 5), the contact area for continuity can be made larger, so that the continuity state can be ensured more surely.

Further, as shown in FIG. 8, the conductive head cover 40 and the conductive film exposure part 36*c* are conducted to each other, thus the continuity state can be ensured surely.

Further, as shown in FIG. 11, on the rear side of the recording paper 6, a voltage is applied between the conductive absorption member 16 arranged not in contact with the recording paper 6 and the conductive film 36 of the nozzle plate 30. Thereby, an electric field is generated overall the nozzle plate 30, thus the range in which the Coulomb force is acted on ink drops can be kept wide.

The preferred embodiments of the present invention are described above in detail to a certain extent, though it is clear that many changes and modifications are available. Therefore, without deviated from the scope and spirit of the present invention, it can be understood that the present invention can be executed by embodiments other than those described here specifically.

What is claimed is:

1. A liquid ejecting head for ejecting a liquid drop from a nozzle opening by changing a pressure of a liquid inside a pressure chamber interconnected to the nozzle opening, comprising:

a nozzle plate including a nozzle substrate made of a non-conductive material, the nozzle opening being formed to pass through the nozzle substrate, the nozzle opening having a narrow part formed on an ejection surface side of the nozzle substrate and an enlarged part formed on an opposite ejections surface side with respect to the narrow part, the enlarged part having a sectional area larger than a sectional area of the narrow part with respect to a section perpendicular to an ejection direction of the liquid drop;

a conductive film formed on an inner peripheral wall surface of the narrow part, the conductive film being made of Ni or NiCr, a film forming area of the conductive film including a moving range of a meniscus which moves on the inner peripheral wall surface of the narrow part in accordance with an ejection operation of the liquid drop from the nozzle opening and;

a water repellent film made of a water repellent material, the water repellent film being formed on a surface of the nozzle substrate on the ejection surface side and not formed on the inner peripheral wall surface of the narrow part.

2. The liquid ejecting head according to claim 1, wherein, the conductive film is formed not only on the inner peripheral wall surface of the narrow part but also overall between the nozzle substrate and the water repellent film.

3. The liquid ejecting head according to claim 2, wherein the water repellent film is not formed on a part of the surface of the nozzle substrate on the ejection surface side so that a part of the conductive film is exposed on the part where the water repellent film is not formed.

4. The liquid ejecting head according to claim 3, further comprising a head cover made of a conductive material, the head cover being mounted on the ejection surface side of the liquid ejecting head, the part, which is exposed, of the conductive film is electrically conducted to the head cover.

5. The liquid ejecting head according to claim 2, wherein a part of the conductive film is extended up to an end surface of the nozzle substrate so as to be exposed on the end surface.

6. The liquid ejecting head according to claim 1, wherein the conductive film is formed not only on the inner peripheral wall surface of the narrow part but also the enlarged part and overall a surface of the nozzle substrate on the opposite ejection surface side.

7. The liquid ejecting head according to claim 1, wherein at least a part of the conductive film corresponding to the moving range of the meniscus is hydrophilic.

8. The liquid ejecting head according to claim 1, wherein the conductive film is electrically conducted to an external circuit.

9. A liquid ejecting apparatus comprising:

the liquid ejecting head as defined in claim 1; and an opposite electrode arranged on a rear side of an article to be processed so as to be opposite to the liquid ejecting head, the liquid ejecting apparatus being structured so as to generate a potential difference between the conductive film and the opposite electrode.

10. The liquid ejecting apparatus according to claim 9, wherein the opposite electrode is made of an absorption member for receiving and absorbing the liquid drop ejected from the nozzle opening toward an area other than the processed article.

11. The liquid ejecting head according to claim 1, wherein a surface of the conductive film is modified by a plasma process or a corona discharge process so as to have a hydrophilic property.

12. The liquid ejecting apparatus according to claim 1, wherein the conductive film is not formed on the enlarged part and the pressure chamber.

* * * * *